US008195062B2

(12) United States Patent
Okada et al.

(10) Patent No.: US 8,195,062 B2
(45) Date of Patent: Jun. 5, 2012

(54) ELECTRICALLY CONDUCTING STRUCTURE AND ELECTRICAL APPARATUS PROVIDED WITH ELECTRICALLY CONDUCTING STRUCTURE

(75) Inventors: Yukihiro Okada, Saitama (JP); Atsuna Saiki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 761 days.

(21) Appl. No.: 12/047,341

(22) Filed: Mar. 13, 2008

(65) Prior Publication Data

US 2008/0273892 A1 Nov. 6, 2008

(30) Foreign Application Priority Data

May 1, 2007 (JP) ..... 2007-120720

(51) Int. Cl.
*G03G 15/00* (2006.01)

(52) U.S. Cl. ..... 399/90

(58) Field of Classification Search ..... 399/90, 399/117

See application file for complete search history.

(56) References Cited

U.S. PATENT DOCUMENTS

| | | | | |
|---|---|---|---|---|
| 4,040,177 | A * | 8/1977 | Beeler et al. | 29/874 |
| 4,839,690 | A * | 6/1989 | Onoda et al. | 399/117 |
| 5,903,803 | A | 5/1999 | Kawai et al. | |
| 6,128,454 | A | 10/2000 | Kawai et al. | |
| 6,175,706 | B1 | 1/2001 | Watanabe et al. | |
| 6,226,478 | B1 | 5/2001 | Watanabe et al. | |
| 6,240,266 | B1 | 5/2001 | Watanabe et al. | |
| 6,336,017 | B1 | 1/2002 | Miyamoto et al. | |
| 6,349,188 | B1 | 2/2002 | Kawai et al. | |
| 6,400,914 | B1 | 6/2002 | Noda et al. | |
| 6,501,926 | B1 | 12/2002 | Watanabe et al. | |
| 2003/0194248 | A1 * | 10/2003 | Anderson, II | 399/90 |
| 2004/0057745 | A1 * | 3/2004 | Kusudo | 399/90 |
| 2006/0045568 | A1 * | 3/2006 | Kishi et al. | 399/111 |

FOREIGN PATENT DOCUMENTS

| | | | |
|---|---|---|---|
| JP | 4151169 | A | 5/1992 |
| JP | 07-225532 | A | 8/1995 |
| JP | 11193136 | A | 7/1999 |
| JP | 11249494 | A | 9/1999 |
| JP | 2002137489 | A | 5/2002 |
| JP | 2005208683 | A | 8/2005 |
| JP | 2005331660 | A * | 12/2005 |
| JP | 200725347 | A | 2/2007 |

OTHER PUBLICATIONS

Japanese Office Action corresponding to Japanese Patent Application No. 2007-120720, dated Feb. 21, 2012.

* cited by examiner

*Primary Examiner* — David Gray
*Assistant Examiner* — Billy J Lactaoen
(74) *Attorney, Agent, or Firm* — Sughrue Mion, PLLC

(57) ABSTRACT

An electrically conducting structure includes: an electrically conductive bar member; a frame member supporting the bar member; and a conducting metal plate, provided with a base portion for mounting the conducting metal plate to the frame member and provided with a contact portion, extending out from the base portion and bending to make contact with a side face of the bar member.

15 Claims, 12 Drawing Sheets

ELECTRICALLY CONDUCTING STRUCTURE AND ELECTRICAL APPARATUS PROVIDED WITH ELECTRICALLY CONDUCTING STRUCTURE

CROSS-REFERENCE TO RELATED APPLICATION

This application claims priority under 35 U.S.C. 119 from Japanese Patent Application No. 2007-120720 filed on May 1, 2007.

BACKGROUND

1. Technical Field

The present invention relates to an electrically conducting structure that conducts electricity, and to an electrical apparatus provided with an electrically conducting structure.

2. Related Art

After the surface of a photoreceptor drum provided in an image forming apparatus has been uniformly charged by a charging device, it is then irradiated with laser light of an exposing device. An electrostatic latent image is thereby formed on the surface of the photoreceptor drum. A toner image is also then formed on the surface of the photoreceptor drum by development of this electrostatic latent image by a developing device, and the toner image is transferred onto a sheet material by a transfer device. Remaining charge that remains on the photoreceptor drum is then finally removed, and the photoreceptor drum is then ready for the next operation.

In order stably to carry out repeated cycles of a sequence of charging, electrostatic latent image forming, developing, transferring, and charge removal in this manner, the photoreceptor drum needs to be constantly earthed to the apparatus body.

Therefore, generally, earthing to the apparatus body is carried out through a shaft (bar member) that is the rotational axial member of the photoreceptor drum.

SUMMARY

An electrically conducting structure according to a first aspect of the present invention includes: an electrically conductive bar member; a frame member supporting the bar member; and a conducting metal plate, provided with a base portion for mounting the conducting metal plate to the frame member and provided with a contact portion, extending out from the base portion and bending to make contact with a side face of the bar member.

BRIEF DESCRIPTION OF THE DRAWINGS

Exemplary embodiments of the present invention will be described in detail based on the following figures, wherein.

DETAILED DESCRIPTION

Explanation will now be given of an image forming apparatus 10, as an electrical apparatus to which an electrically conducting structure according to an exemplary embodiment of the present invention is applied, with reference to FIG. 1A to FIG. 12.

Figure 11:
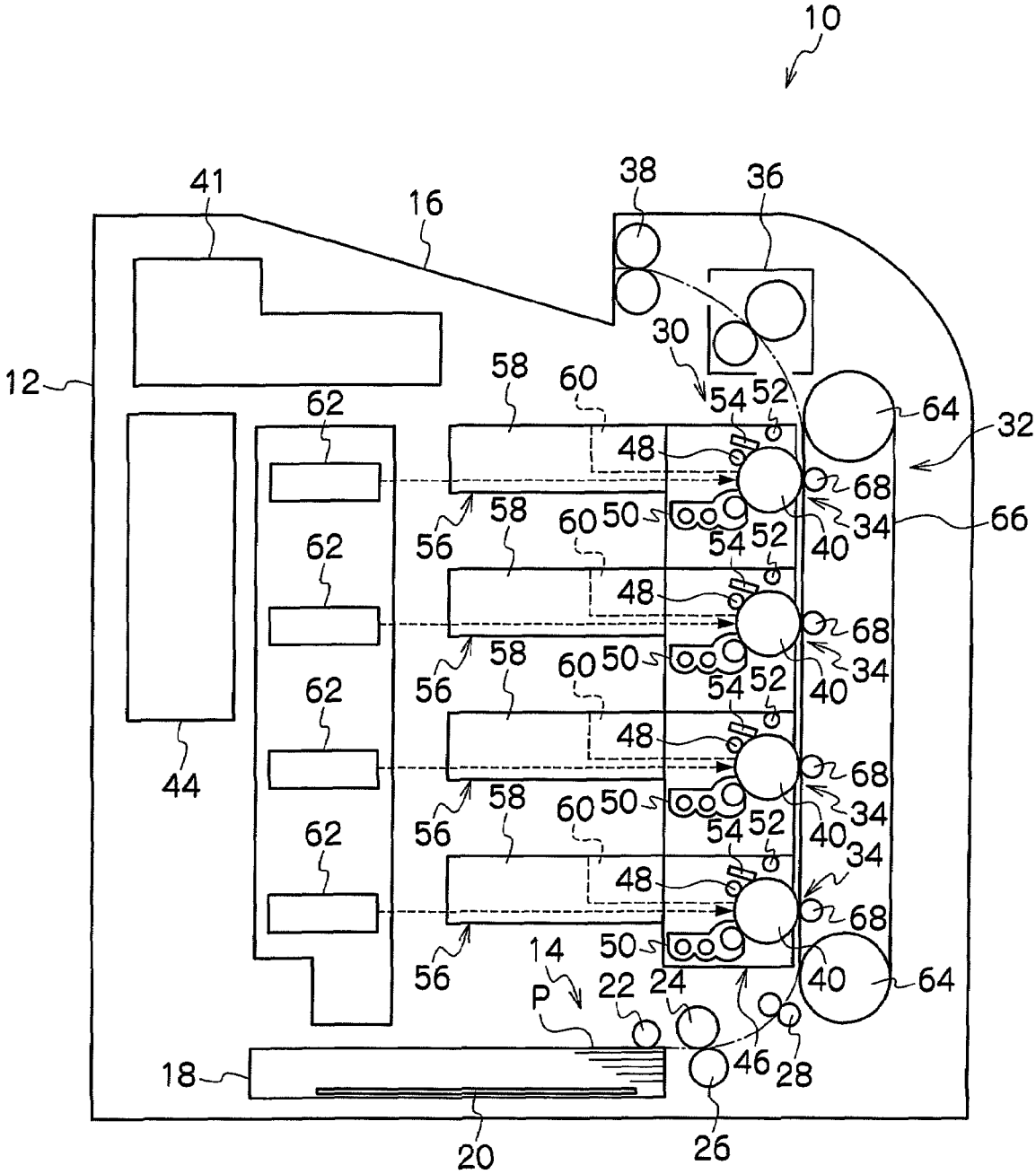
FIG. 11 is an outline diagram showing a configuration of an image forming apparatus to which an electrically conducting structure according to an exemplary embodiment of the present invention is applied.

As shown in FIG. 11, there is a case 12 in the image forming apparatus 10, and a sheet feeder device 14 is disposed at a lower portion of the case 12. There is also an output tray 16 provided at an upper portion of the case 12, for outputting sheet material to which images have been formed.

Furthermore, the sheet feeder device 14 is provided with a paper feed cassette 18, and plural sheets of material P are stacked and accommodated within the paper feed cassette 18. There is also a bottom plate 20 provided to the paper feed cassette 18, onto which the sheets of material P are stacked. When sheets of material P are supplied to respective transfer units 34 of plural photoreceptor drums 40 that are supported in photoreceptor units 30, described later, the bottom plate 20 moves upward due to a raising and lowering mechanism (not illustrated). It is configured such that the sheet of material P that is stacked at the uppermost portion on the bottom plate 20 is in press contact with a pick-up roll 22. Furthermore, the bottom plate 20 is configured such that, on pulling out the paper feed cassette 18 from the case 12, the bottom plate 20 moves downward with the raising and lowering mechanism so that the sheets of material P may be accommodated within the paper feed cassette 18.

Furthermore, when the sheets of material P are fed out to the transfer units 34, the sheets of material P that are stacked uppermost on the bottom plate 20 are fed out in sequence by the pick-up roll 22, and conveyed one sheet at a time by a driven rotating paper feed roll 24 and a separation roll 26.

It is configured such that the sheets of material P that are conveyed from the paper feed cassette 18 are stopped for a moment by a register roller 28, pass between the photoreceptor unit 30 and a transfer unit 32 with a predetermined timing, described later, and then also pass through a fixing device 36 that fixes a toner image on the sheets of material P, and are then output to the output tray 16 by an output roll 38.

The photoreceptor unit 30, the transfer unit 32, a power unit 41 and a control unit 44 are disposed between the sheet feeder device 14 and the output tray 16. There is a photoreceptor frame 46 provided to the photoreceptor unit 30, and four photoreceptor drums 40 are rotatably supported by the photoreceptor frame 46.

Furthermore, around the periphery of each of the photoreceptor drums 40 there is provided: a charging device 48, equipped with a charging roll for uniformly charging the photoreceptor drum 40; a developing unit 50, for developing with developer (toner) latent images that have been written to each of the photoreceptor drum 40; a charge removal device 52, for removing charge from the photoreceptor drum 40 after transfer; and a cleaning device 54, for removing developer remaining on the photoreceptor drum 40 after transfer has been undertaken.

The photoreceptor unit 30 is also unitized with the four photoreceptor drums 40, the four charging devices 48, the four developing units 50, the four charge removal devices 52 and the four cleaning devices 54 retained in the photoreceptor frame 46, and the photoreceptor unit 30 is able to be fitted to, and removed from, the case 12. Details regarding the photoreceptor drum 40 will be explained later.

Four toner boxes 56 corresponding to the four developing units 50 are connected to the rear face side of the photoreceptor unit 30. These toner boxes 56 are used for magenta, yellow, cyan and back, and are each configured as a unit with a tonner supply section 58 and a tonner recovery section 60. The tonner supply sections 58 are also connected to the developing units 50, so that each of the colors of toner is supplied to the respective developing unit 50. The tonner recovery section 60 is also configured connected to the cleaning device 54 so that each of the colors of tonner is recovered.

To the rear side of the photoreceptor unit 30 there are exposing devices 62, for writing a latent image with laser light on each of the respective photoreceptor drums 40, the exposing devices 62 being disposed in positions corresponding to the respective photoreceptor drum 40, and irradiating a laser to the uniformly charged photoreceptor drums 40 so as to form latent images.

The transfer unit 32 is disposed to the front side of the photoreceptor units 30, and is disposed in a vertical direction so as to face photoreceptor units 30. This transfer unit 32 is provided with: two support rolls 64, provided to the top and the bottom; a conveying belt 66, entrained around the two rolls 64; and transfer rolls 68, provided in positions that face each of the respective photoreceptor drums 40, nipping the conveying belt 66 therebetween.

The image forming apparatus 10 configured as described above forms images in the following manner.

Each of the charging devices 48 first gives the surface of the respective photoreceptor drum 40 a uniform minus charge of the planned charging unit potential. Then exposure is carried out to the image portions on the charged photoreceptor drum 40 using the exposing device 62, so as to give the planned exposure unit potential, and a latent image is formed.

In other words, by modulating a semi-conductor laser (omitted in the drawings) on/off, on the basis of image data supplied from a control unit 44, latent images are formed on each of the photoreceptor drums 40 corresponding to the images.

Furthermore, when the latent image on the rotating photoreceptor drum 40 passes the developing unit 50, developer G that has been stored in the developing unit 50 is adhered to the electrostatic latent image by electrostatic force, and the latent image is made visible as a toner image.

When this is carried out, the sheets of material P that are stacked in the paper feed cassette 18 are fed out by the pick-up roll 22, and these sheets of material P are conveyed out one sheet at a time by the rotation driven paper feed roll 24 and separation roll 26. The sheets of material P that have been conveyed out from the paper feed cassette 18 are temporarily stopped at the register roller 28, and then conveyed out between the photoreceptor unit 30 and the transfer unit 32 with a predetermined timing. The sheets of material P are retained by the conveying belt 66 and conveyed toward the transfer unit 34 of each of the photoreceptor drums 40, and toner images on the photoreceptor drums 40 are transferred in sequence onto the sheets of material P when the sheets of material P pass the transfer units 34.

The toner images that have been transferred onto the sheets of material P are fixed in the fixing device 36, and the sheets of material P are output into the output tray 16 by the output roll 38.

Explanation will now be given of details of the photoreceptor drum 40.

Figure 10:
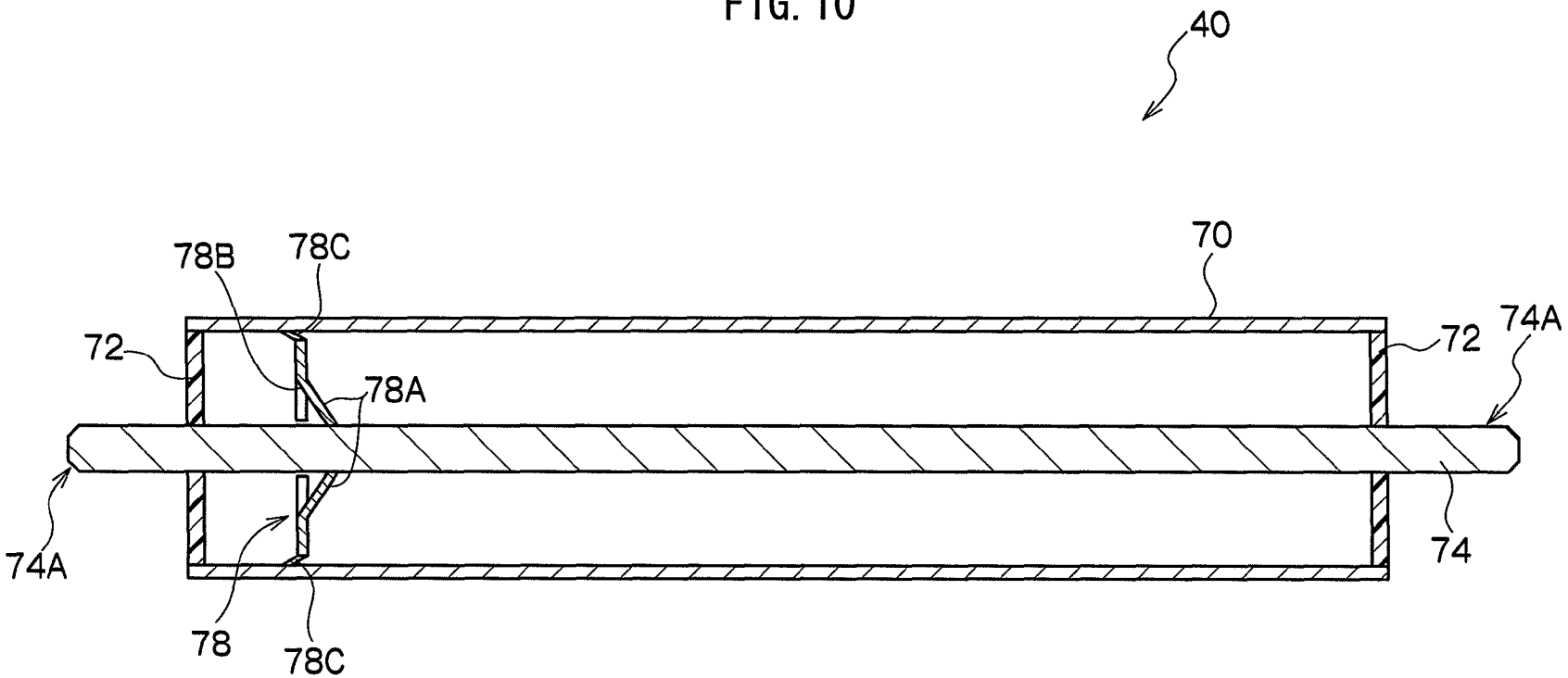
FIG. 10 is cross-section showing a photoreceptor drum of an image forming apparatus to which an electrically conducting structure according to an exemplary embodiment of the present invention is applied.

As shown in FIG. 10, in the photoreceptor drum 40 there is a circular cylindrical shaped circular cylinder base 70 provided, on which the toner image is formed, and the circular cylinder base 70 is formed by working a conductive sheet member (such as an aluminum sheet member, for example) into a circular cylindrical shape. At the axial center of the circular cylinder base 70 there is a circular rod shaped shaft 74, serving as a bar member, provided so as to axially and rotatably support the photoreceptor drum 40. The shaft 74 is formed from a conductive metal material, and there are beveled portions 74A at both ends of the shaft 74, where the corner portions have been beveled.

There are also circular disk shaped lid members 72 provided one at each of the two ends of the circular cylinder base 70, so as to cover the openings at both ends of the circular cylinder base 70, and the lid members 72 retain the circular cylinder base 70 on the shaft 74.

Figure 9:
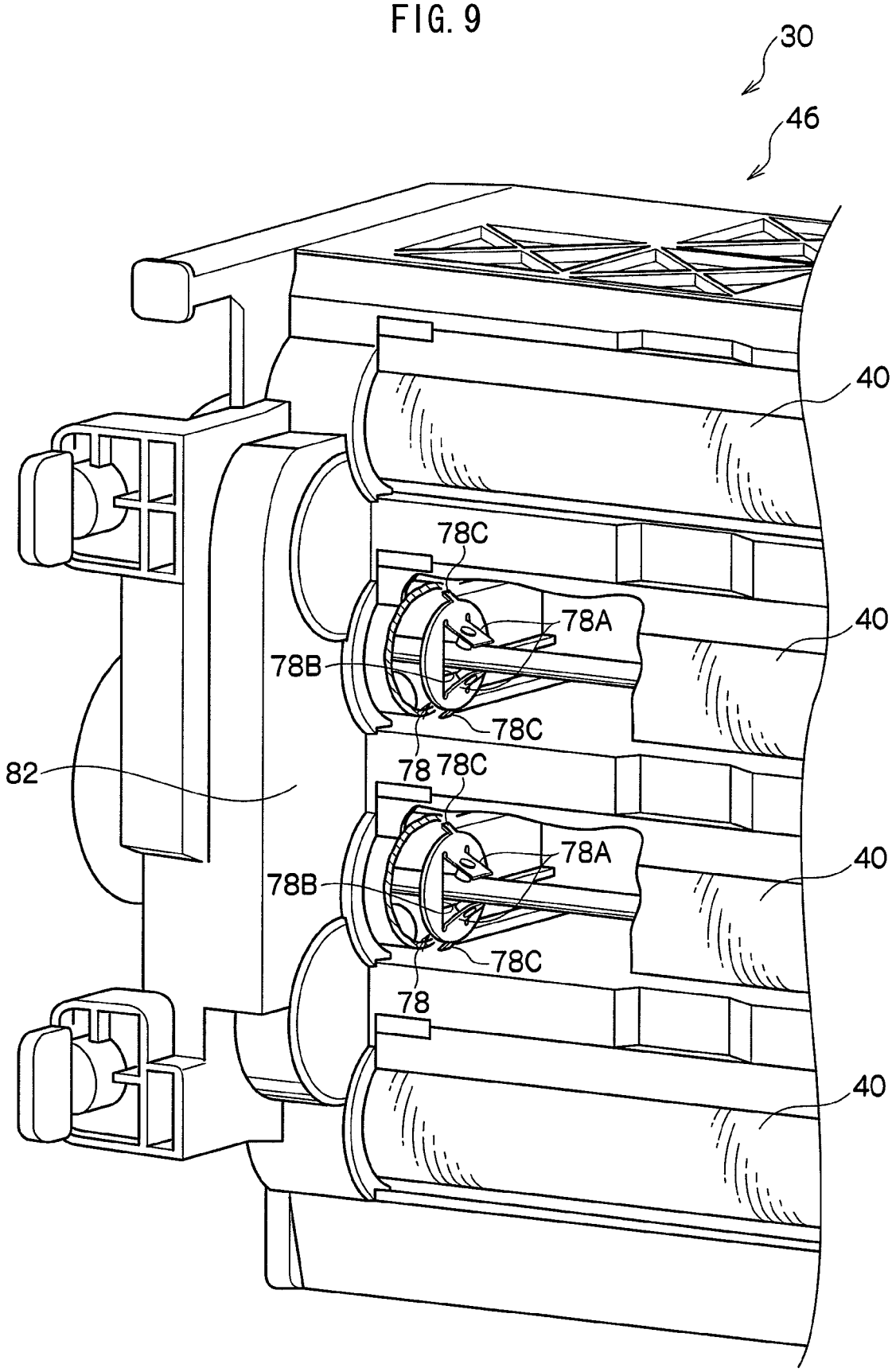
FIG. 9 is a perspective view showing a photoreceptor unit of an image forming apparatus to which an electrically conducting structure according to an exemplary embodiment of the present invention is applied.

There is also a conducting circular plate 78 provided within the circular cylinder base 70, as shown in FIG. 9 and FIG. 10, and a pair of rectangular shaped flanges 78A are provided, with the shaft 74 pressed therebetween, at a central portion of an opening 78B in the conducting circular plate 78. At the outer peripheral edge portion of the conducting circular plate 78 there is a pair of flanges 78C that each extend toward the outside, bending and contacting the inner peripheral face of the circular cylinder base 70.

By such a configuration, the circular cylinder base 70 and the shaft 74 are electrically conductive through the conducting circular plate 78.

Figure 8:
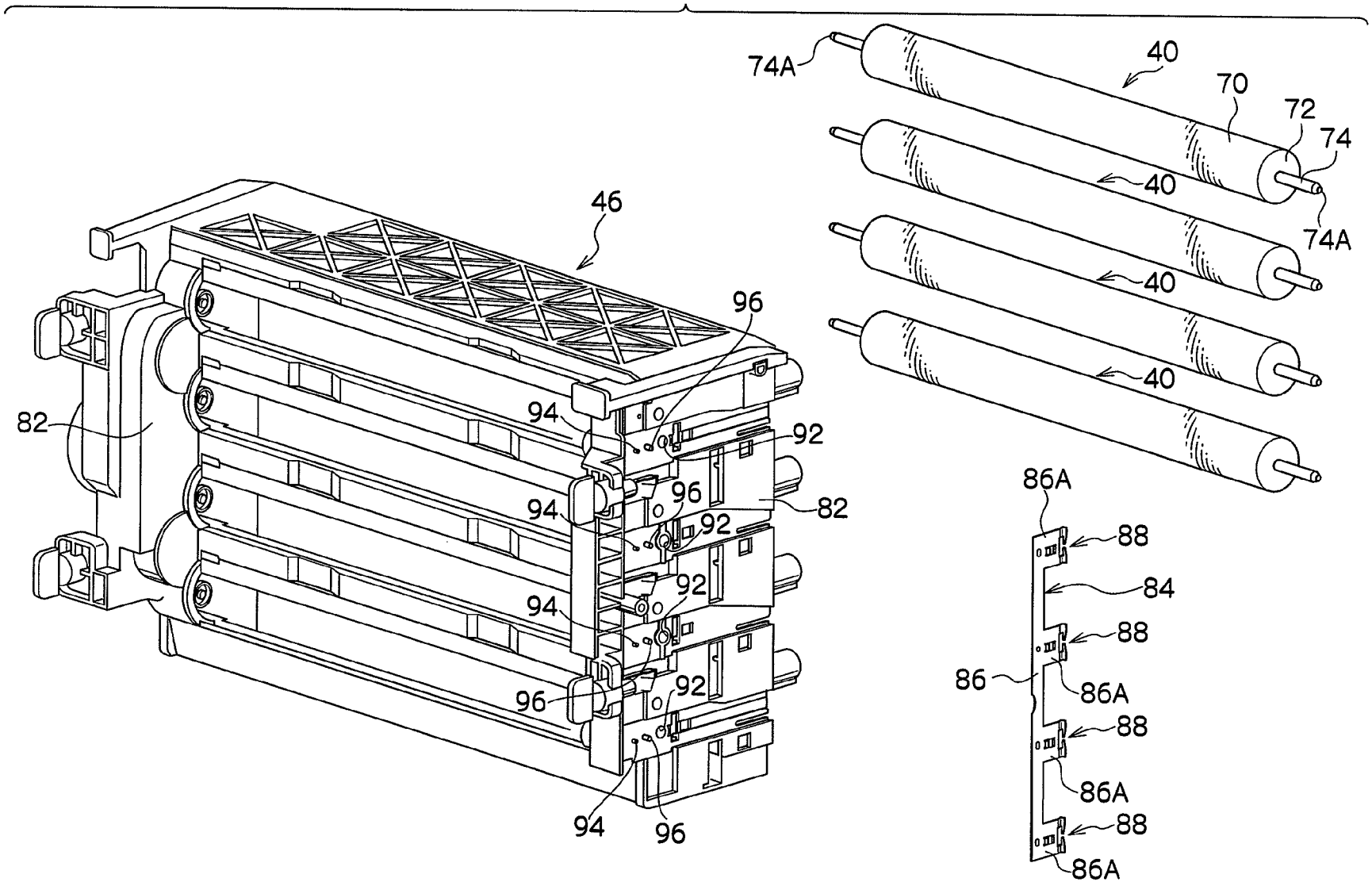
FIG. 8 is an exploded perspective view showing a photoreceptor unit of an image forming apparatus to which an electrically conducting structure according to an exemplary embodiment of the present invention is applied.

As shown in FIG. 8, there is a pair of side plates 82 provided extending in a vertical direction to the photoreceptor frame 46, the side plates 82 supporting the four photoreceptor drums 40, each being formed as a unit from a resin material, and retaining the photoreceptor drums 40. There are circular holes 92 provided in these side plates 82, rotatably supporting the shafts 74 of the photoreceptor drums 40.

There is a conducting metal plate 84 provided at one side at the outside of the side plates 82, for earthing the photoreceptor drum 40 to the body of the image forming apparatus 10, the conducting metal plate 84 being fixed to one of the side plates 82.

The conducting metal plate 84 is formed from a stainless steel thin sheet member, and is provided with four base portions 86A that extend out, toward the four circular holes 92, laterally from locations on a vertically extending plate portion 86.

There are four pairs of contact tabs 88 provided extending out from the base portions 86A, bending and contacting the shafts 74.

Figure 3:
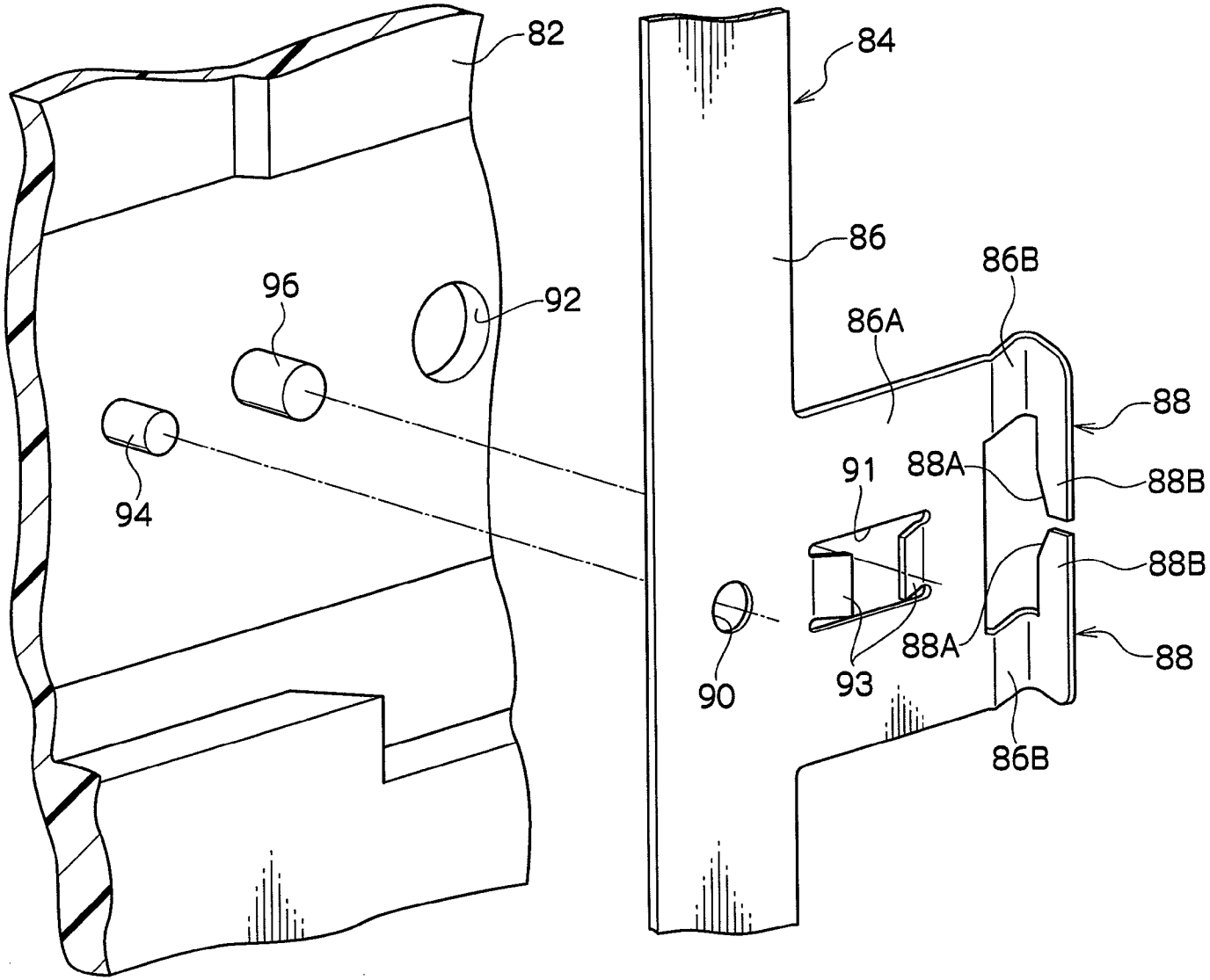
FIG. 3 shows an electrically conducting structure according to an exemplary embodiment of the present invention, in which a conductive metal plate and a side plate are shown in a disassembled enlarged perspective view.

As shown in FIG. 3, there are pins 94 provided to the side plate 82 at heights that are the same as those of the holes 92, and a circular positioning hole 90 is formed in the plate portion 86, into which one of the pins 94 is inserted.

Figure 6:
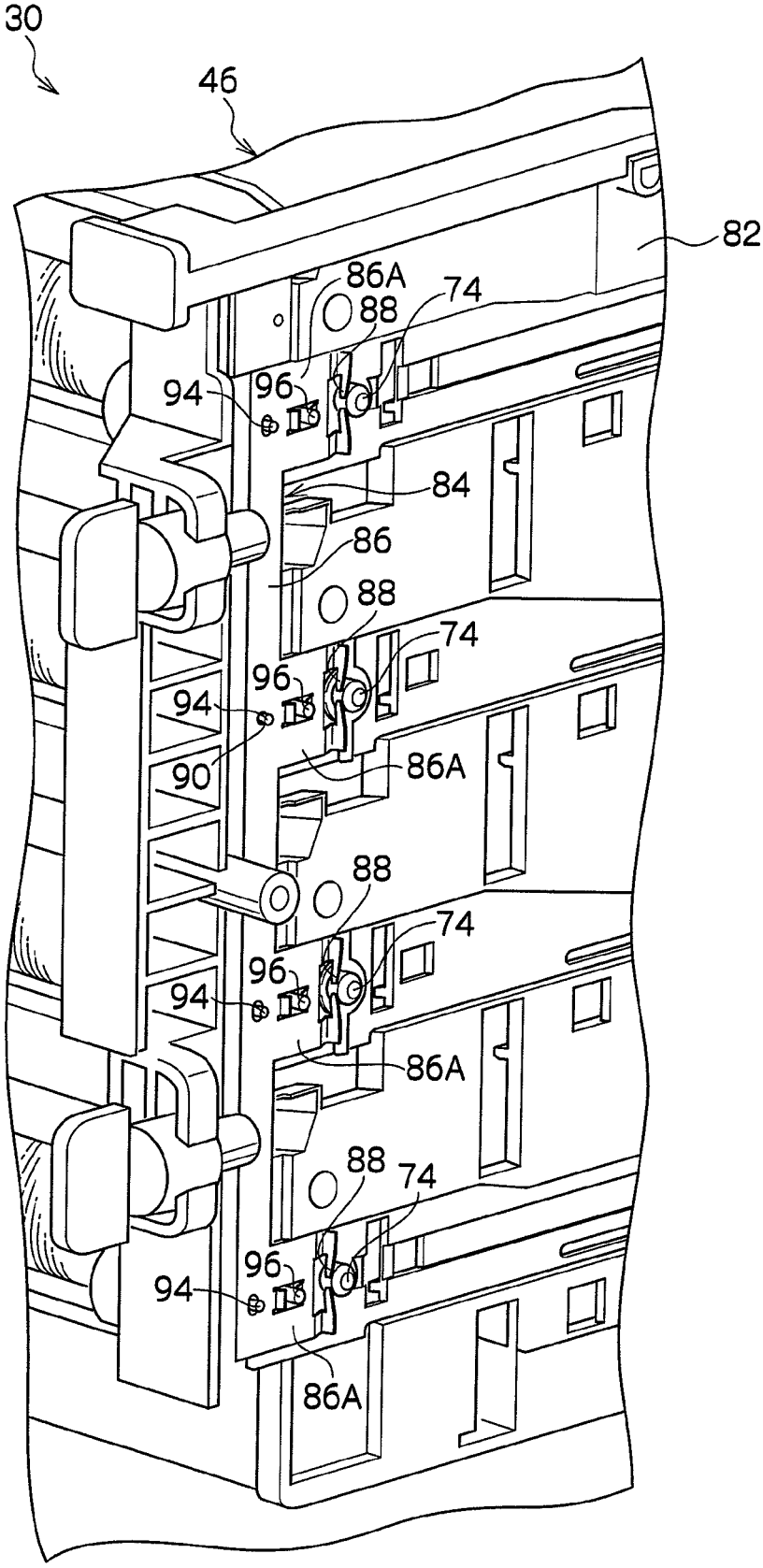
FIG. 6 shows an electrically conducting structure according to an exemplary embodiment of the present invention in which a side plate, a conductive metal plate and a shaft are shown in perspective view.

There is a pair of claw portions 93 provided to each of the base portions 86A, the pair of claw portions 93 being provided, extending toward each other, at sets of opposing edge portions of rectangular shaped openings 91 in the base portions 86A. It should be noted that, as shown in FIG. 6, the other pins 94, which are not the pin 94 that is inserted into the positioning hole 90, are inserted into holes that are elongated in the up-down direction, thereby enabling any variation in the positioning of the pins 94 in the up-down direction to be absorbed.

There are pins 96 provided between the pins 94 and the holes 92 of the side plate 82, the pins 96 being slightly larger than pins 94, the pins 96 intruding between the pairs of claw portions 93 with the claw portions 93 biting thereon so as to fix the conducting metal plate 84 to the side plates 82.

Figure 2:
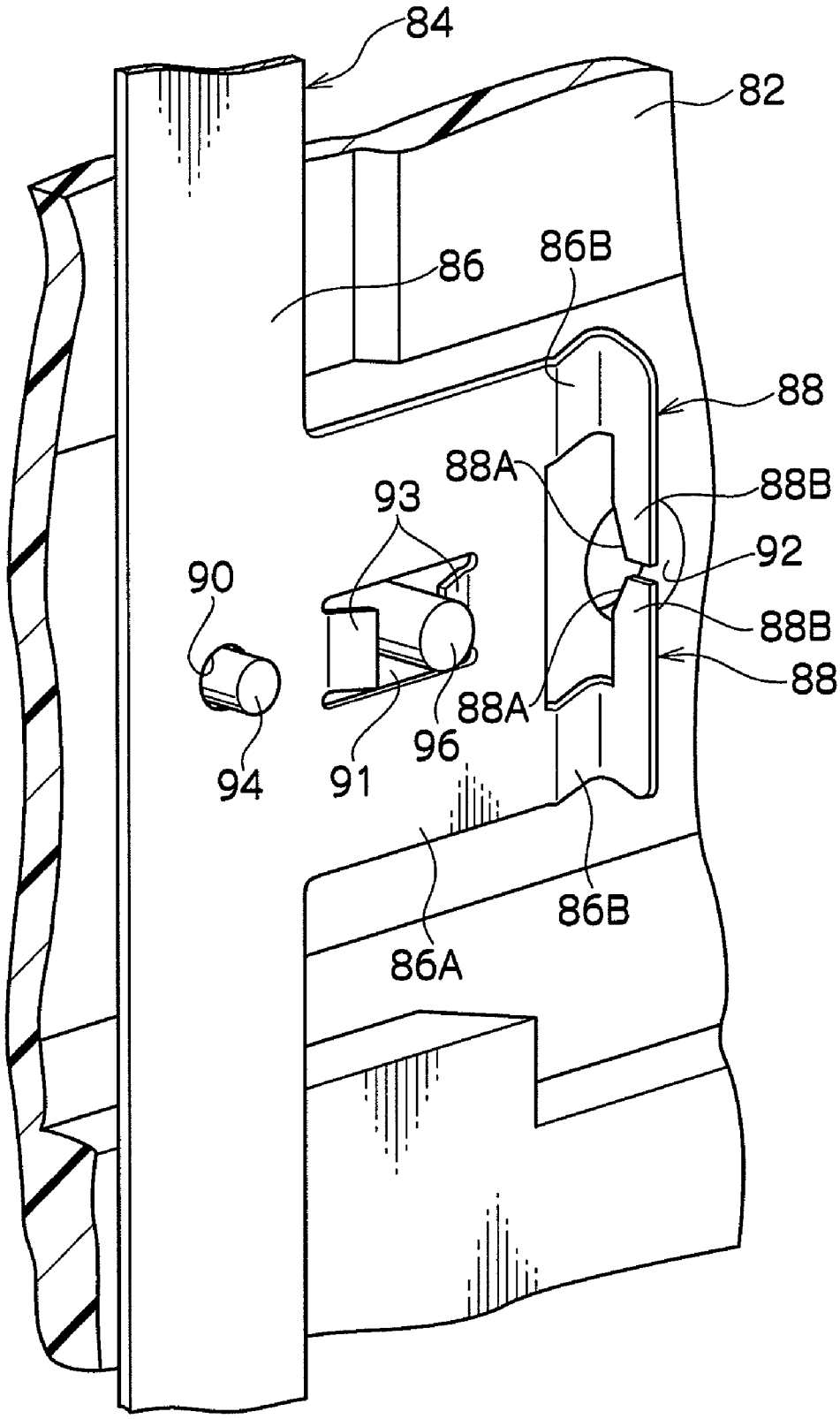
FIG. 2 shows an electrically conducting structure according to an exemplary embodiment of the present invention, showing a fixed state of a conductive metal plate to a side plate in an enlarged perspective view.

As shown in FIG. 2, the conducting metal plate 84 is, by such a configuration, positioned in a predetermined position by the pins 94, and fixed to the side plate 82 such that the claw portions 93 bite onto the pins 96.

Furthermore, there is a pair of extending base portions 86B that extends out from each of the base portions 86A, one at each of the two edge portions of the base portions 86A, with a predetermined spacing between each other, bending around toward the side plate 82 side. The contact tabs 88 extend out in a cantilever manner toward each other from these extending base portions 86B, over the holes 92. In addition, there are corner beveled angled portions 88A formed to the corner portions facing the side plate 82 of free end portions 88B on the contact tabs 88, so that the contact tabs 88 get narrower on progression toward the leading end thereof.

Figure 1C:
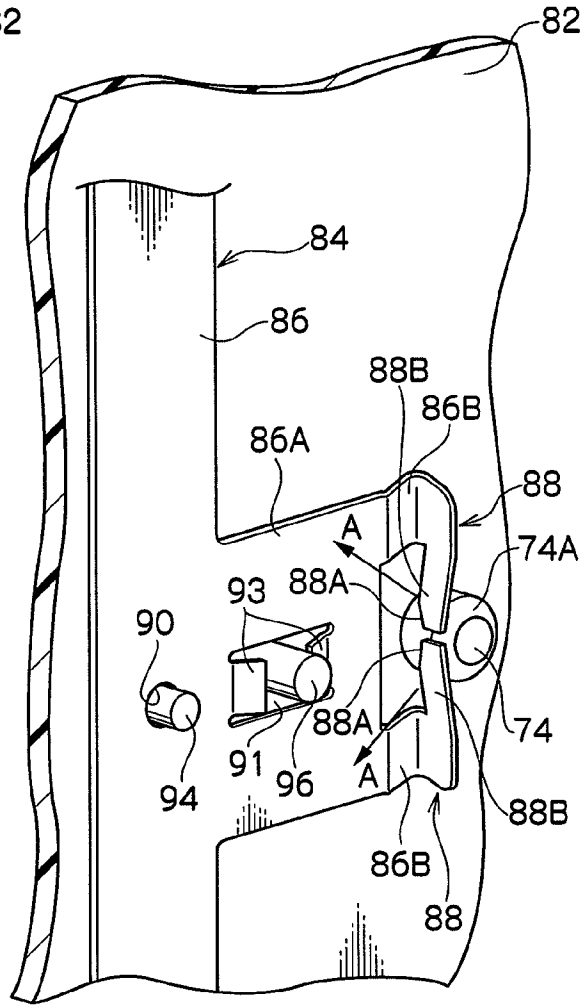
FIGS. 1A, 1B and 1C show an electrically conducting structure according to an exemplary embodiment of the present invention, showing, in perspective view, states in which contact tabs of a conductive metal plate are being contacted with the outer peripheral face of a shaft.
Figure 1B:
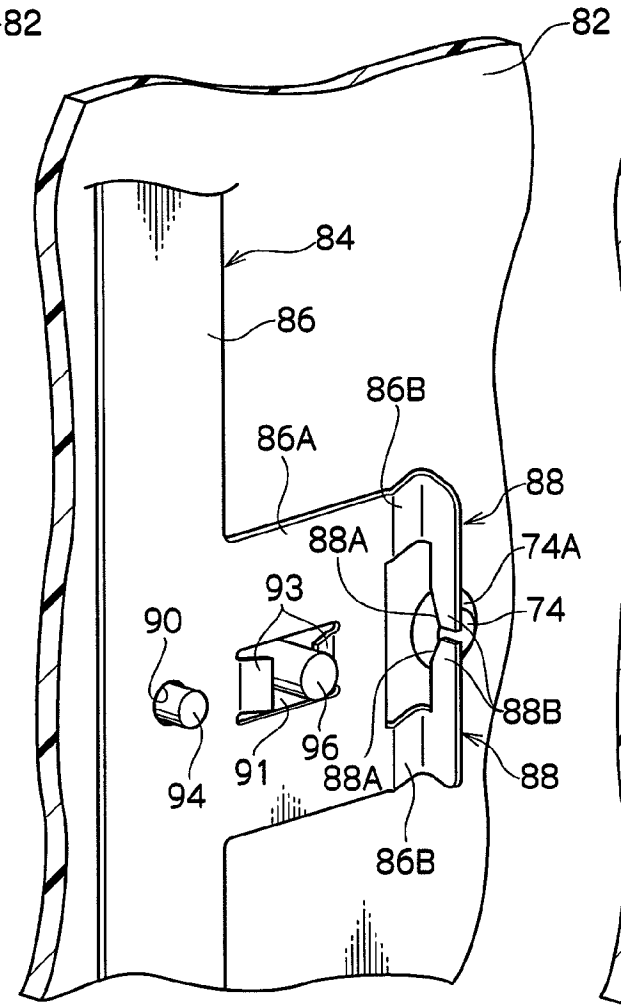
Figure 1A:
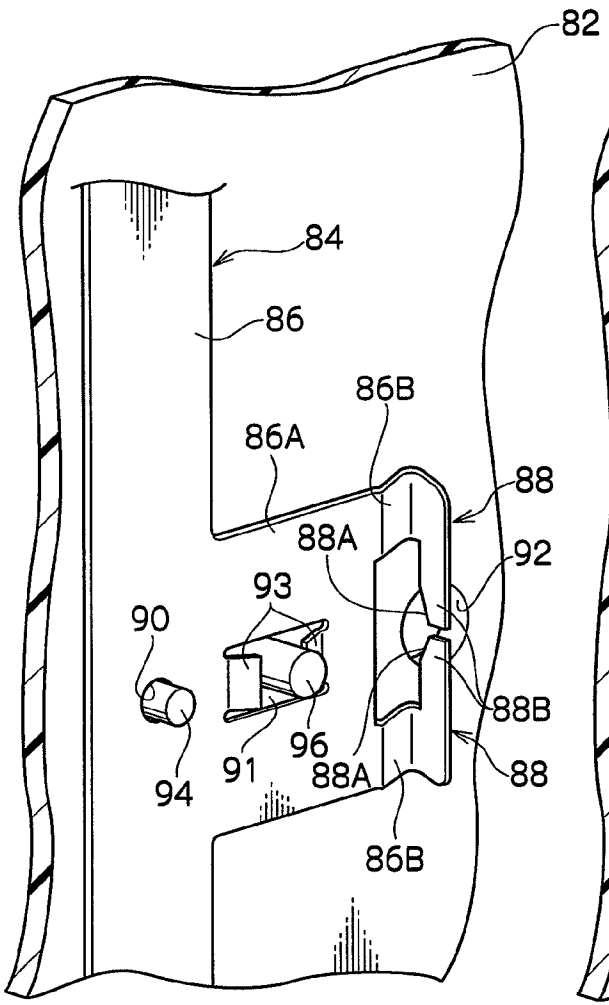
Figure 4:
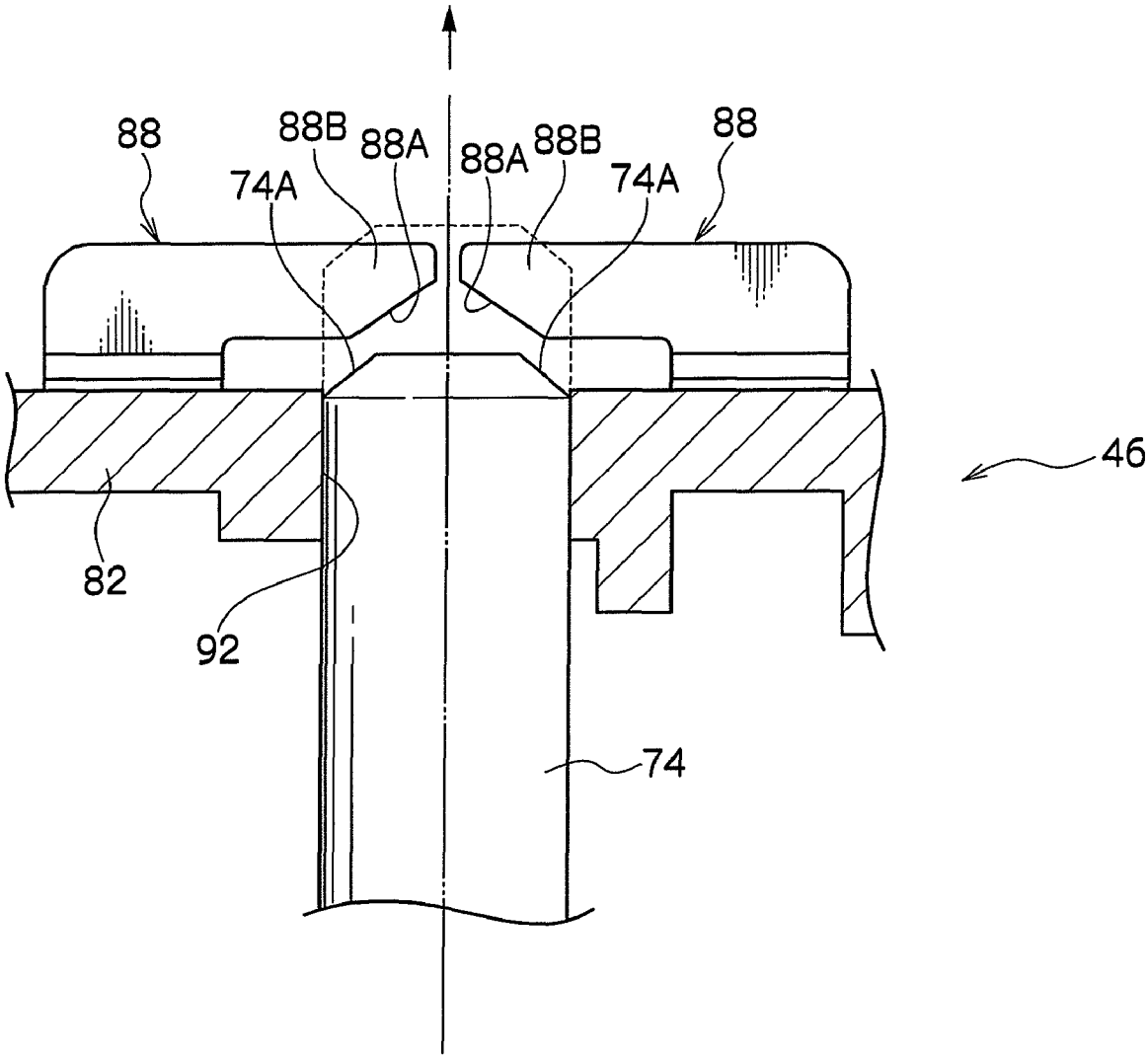
FIG. 4 shows an electrically conducting structure according to an exemplary embodiment of the present invention, in which contact tabs and a shaft side plate are shown in a side view.

As shown in FIGS. 1A, 1B and FIG. 4, when the shafts 74 are inserted from the inside of the photoreceptor frame 46 into the holes 92, positioning is set such that the beveled portions 74A that are provided at leading end corner portions of the shafts 74 contact with the angled portions 88A of the contact tabs 88.

Furthermore, as shown in FIG. 1C, when the shafts 74 are further pushed in from the inside to protrude out from the side plate 82, the free end portions 88B of the pair of contact tabs 88 bend in the radial direction of the shafts 74 (direction of arrow A in FIG. 1C) such that the contact tabs 88 contact with the outer peripheral face of the shafts 74 at two locations. Namely, the faces of the beveled portions 74A that have been provided to the leading end corner portions of the shafts 74 are faces that are angled with respect to the movement direction of the shafts 74. The shafts 74 do not become caught on the contact tabs 88, since the beveled portions 74A push the angled portions 88A of the contact tabs 88. Instead the free end portions 88B of the contact tabs 88 bend in the radial direction of the shafts 74, following the angled face of the beveled portions 74A.

Figure 5:
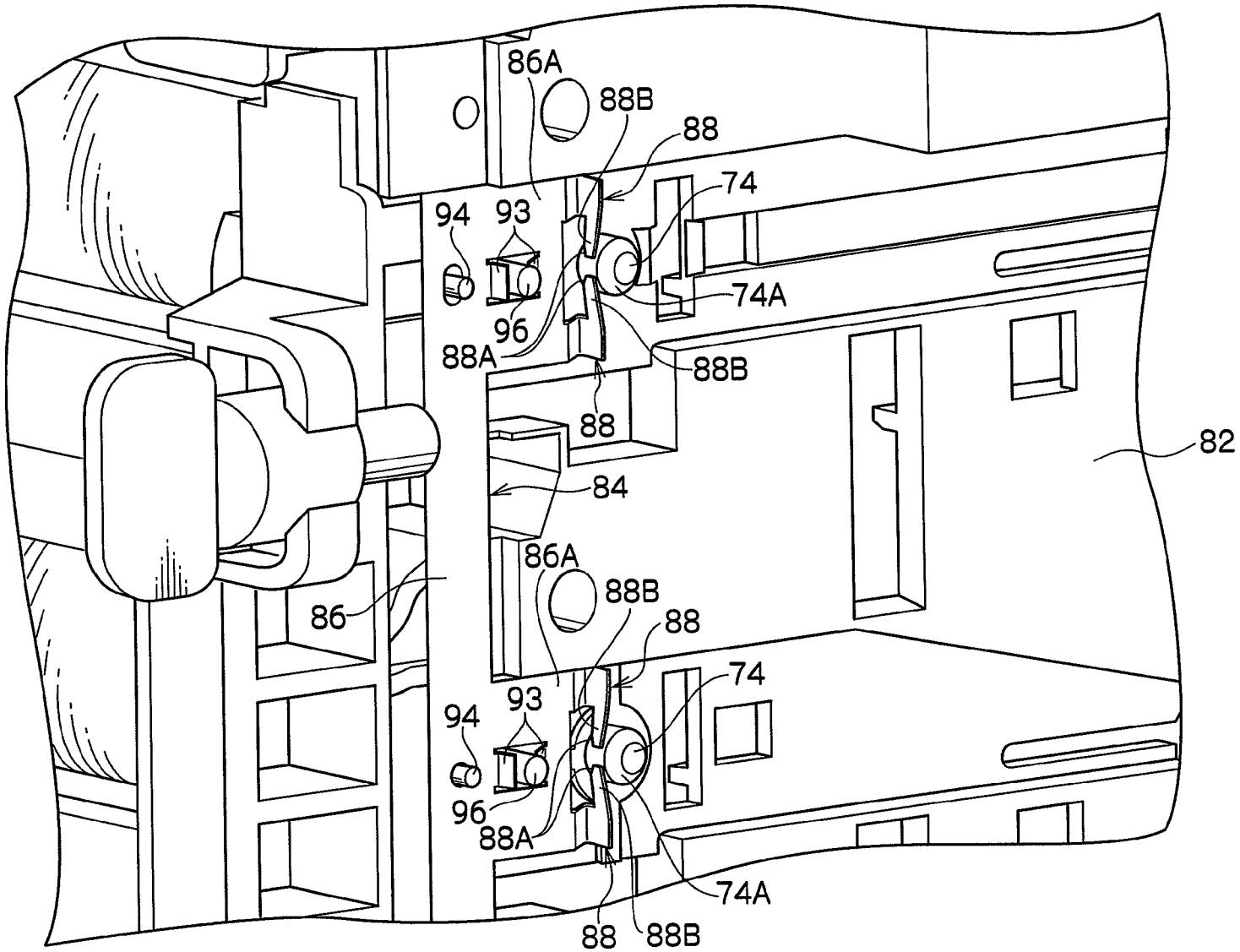
FIG. 5 shows an electrically conducting structure according to an exemplary embodiment of the present invention in which a conductive metal plate and a side plate are shown in an enlarged perspective view.
Figure 7:
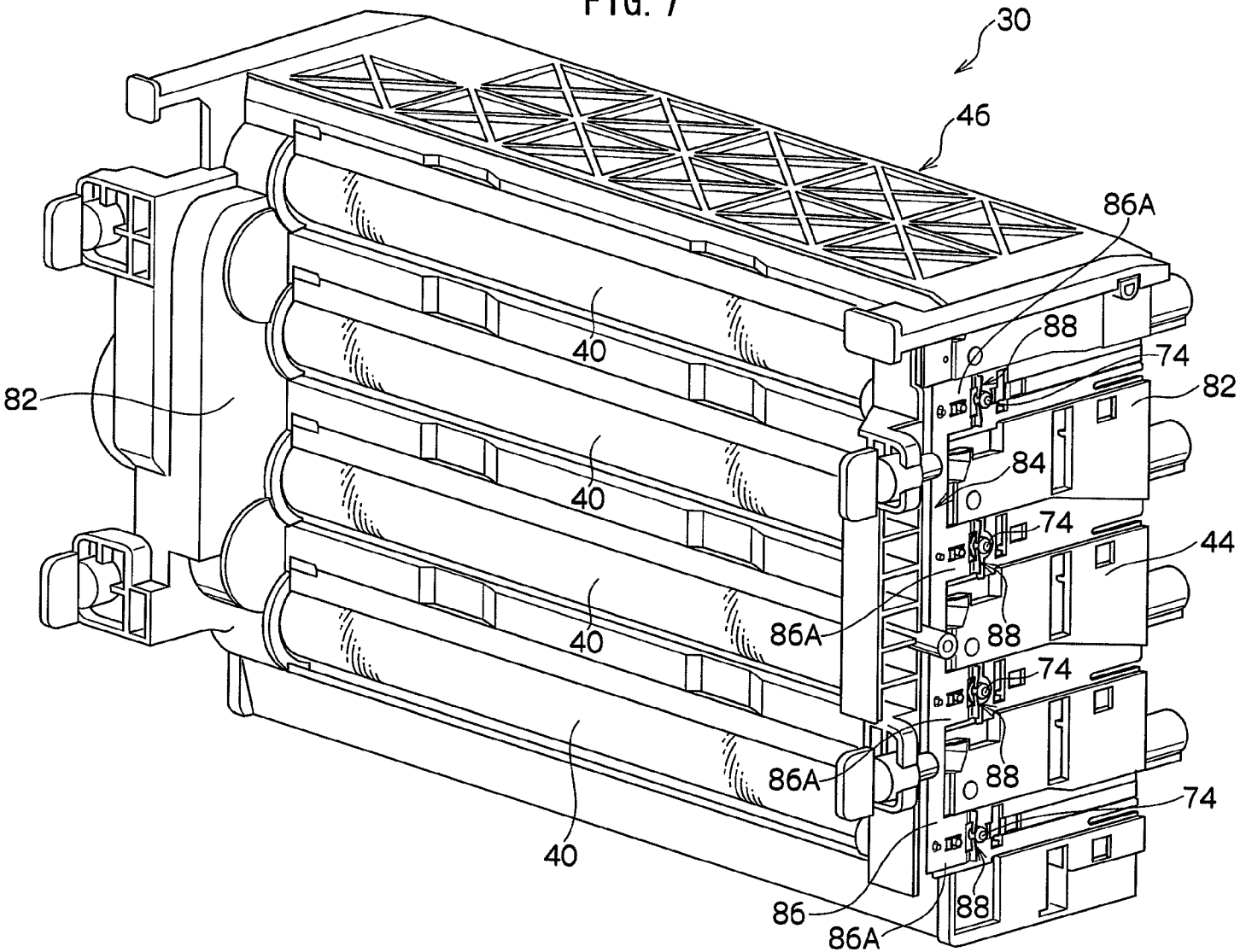
FIG. 7 is a perspective view showing a photoreceptor unit of an image forming apparatus to which an electrically conducting structure according to an exemplary embodiment of the present invention is applied.

By so doing, as shown in FIGS. 5 and 7, the shafts 74 of the four photoreceptor drums 40 are electrically conductive to the contact tabs 88 of the conducting metal plate 84, and the photoreceptor drums 40 are earthed to the image forming apparatus 10 body.

Since the contact tabs 88 contact the outer peripheral faces of the shafts 74, electrically continuity may be obtained between the shafts 74 and the conducting metal plate 84 even in instances where there is no space to the outside in the axial direction of the shafts 74. Furthermore, if the shafts 74 are pushed in further than a predetermined amount, since the contact tabs 88 contact with the outer peripheral face of the shafts 74, there is no bending by more than the predetermined amount, and the conducting metal plate 84 is not deformed.

Also, since the free end portions 88B of the contact tabs 88 are caused to bend in the radial direction of the shafts 74, the free end portions 88B may be made to bend without the application of a great amount of force.

The free end portions 88B of the contact tabs 88 are made to bend, and since the contact tabs 88 contact with the outer peripheral face of the shafts 74 at two locations, the shafts 74 may be placed in contact with the contact tabs 88 in a stable condition of contact.

Figure 12:
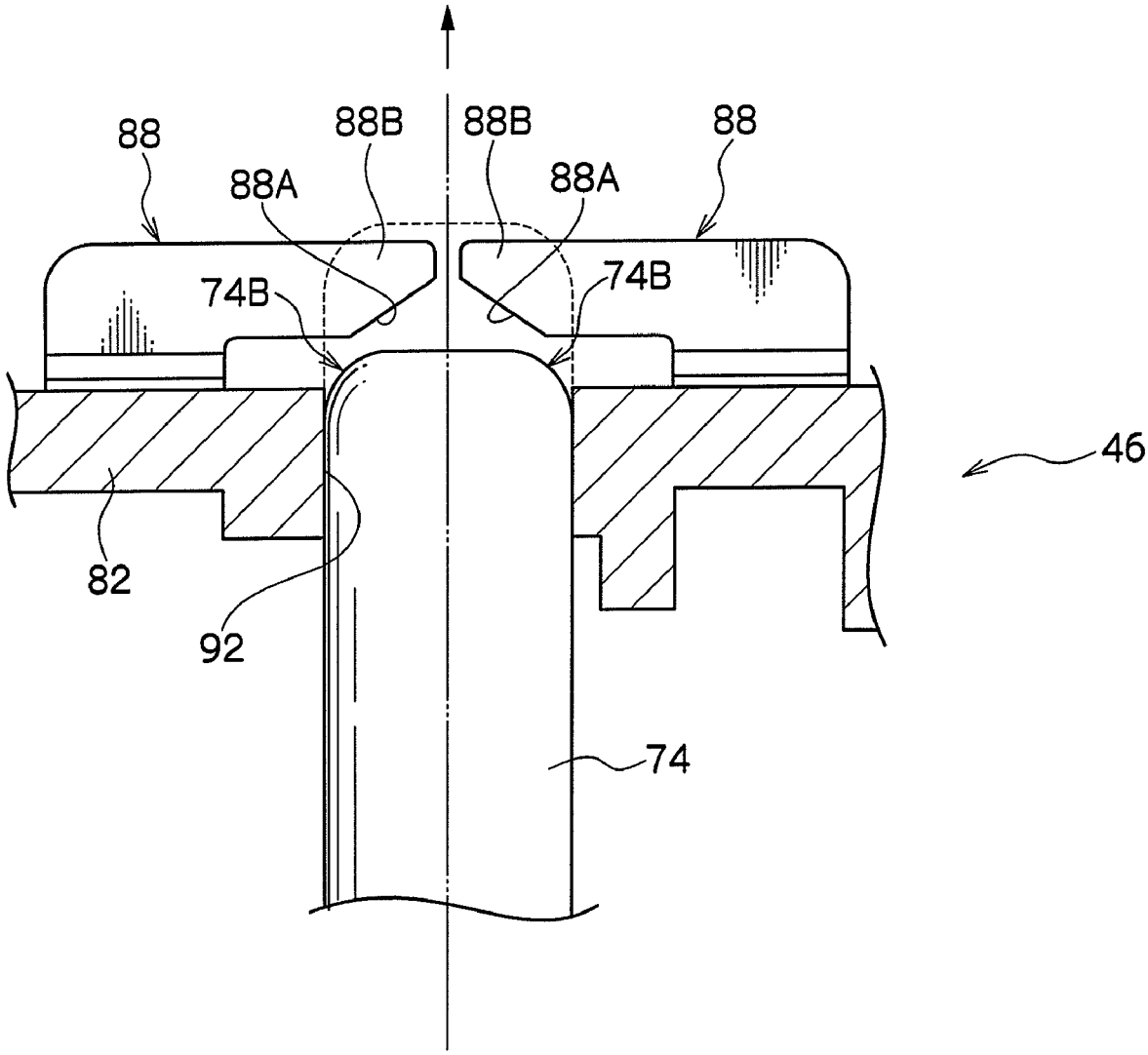
FIG. 12 shows an electrically conducting structure according to an exemplary embodiment of the present invention in which contact tabs and a shaft side plate are shown in side view.

It should be noted that the present invention has been explained by way of the details of a particular exemplary embodiment thereof, however, the present invention is not limited thereby, and it is obviously clear to practitioners of skill in the art that various other exemplary embodiments are possible within the scope of the present invention. For example, in the exemplary embodiment described above, the beveled portions 74A were provided to end portions of the shafts 74, and the angled portions 88A of the contact tabs 88 were pushed with these beveled portions 74A, however, in their place a radiused face portion 74B may be provided as a rounded-off corner portion of the leading end corners of the shafts 74, as shown in FIG. 12, and the angled portions 88A of the contact tabs 88 may be pushed by this radiused face portion 74B.

Furthermore, in the present exemplary embodiment of the present invention, the image forming apparatus 10 was used as an electrical apparatus, however, all types of electrical apparatus are applicable as long as there is a bar member and an conducting metal plate to be earthed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrically conducting structure comprising:

an electrically conductive bar member;

a frame member supporting the bar member; and a conducting metal plate, provided with a base portion for mounting the conducting metal plate to the frame member and provided with a contact portion extending out from the base portion and bending to make contact with a side face of the bar member, wherein a free end portion of the contact portion bends in a radial direction of the bar member, and the free end portion of the contact portion does not bend in an axial direction of the bar member.

2. The electrically conducting structure of claim 1, wherein the bar member is of a substantially circular rod shape, the contact portion comprises a pair of contact tabs that extend out from the base portion in a cantilever manner in a direction along which leading ends of the contact tabs face each other, and the free end portion of the contact portion comprises free end portions of the contact tabs that bend in the radial direction of the bar member and make contact with the outer peripheral face of the bar member.

3. The electrically conducting structure of claim 2, wherein:

the bar member is supported by the frame member so as to be able to move in the axial direction of the substantially circular rod shape;

a corner portion of a leading end of the bar member comprising a beveled portion; and angled portions provided at the free end portions of the contact tabs such that width of the contact tabs narrows on progression towards the free end portions, the angled portions being pressed by the beveled portion, thereby bending the contact tabs.

4. The electrically conducting structure of claim 2, wherein:

the bar member is supported by the frame member so as to be able to move in the axial direction;

a corner portion of a leading end of the bar member comprising a radiused face portion; and angled portions provided at the free end portions of the contact tabs such that width of the contact tabs narrows on progression towards the free end portions, the angled portions being pressed by the radiused face portion, thereby bending the contact tabs.

5. An electrical apparatus provided with an electrically conducting structure, the electrically conducting structure comprising:

an electrically conductive bar member;

a frame member supporting the bar member; and a conducting metal plate, provided with a base portion for mounting the conducting metal plate to the frame member and provided with a contact portion extending out from the base portion and bending to make contact with a side face of the bar member, wherein a free end portion of the contact portion bends in a radial direction of the bar member, and the free end portion of the contact portion does not bend in an axial direction of the bar member.

6. An electrically conducting structure comprising:

an electrically conductive bar member;

a frame member that includes a mounting face comprising a through hole, the frame member supporting the bar member with the bar member passing through the through hole; and a conducting metal plate comprising a contact portion that is elastically bent and contacts a side face of the bar member that is protruding out from the through hole, the conducting metal plate further comprising a base portion that is substantially parallel to the mounting face, the base portion being mounted to the mounting face of the frame member, wherein a free end portion of the contact portion bends in a radial direction of the bar member, and the free end portion of the contact portion does not bend in an axial direction of the bar member.

7. The electrically conducting structure of claim 6, wherein the contact portion comprises a first contact portion and a second contact portion, and the bar member contacts the conducting metal plate so as to be sandwiched between the first and second contact portions.

8. The electrically conducting structure of claim 6, wherein the bar member comprises a beveled leading end portion, and the bar member projects out from the side of the frame member on which the conducting metal plate is mounted.

9. The electrically conducting structure of claim 6, wherein the bar member comprises a radiused face leading end portion, and the bar member projects out from the side of the frame member on which the conducting metal plate is mounted.

10. The electrically conducting structure of claim 6, wherein the bar member is of a substantially circular rod shape.

11. The electrically conducting structure of claim 7, wherein the first contact portion and the second contact portion comprise first and second contact tabs, respectively, that extend out from the base portion in a cantilever manner in a direction along which leading ends of the first and second contact tabs face each other, and angled portions are provided at free end portions of the first and second contact tabs, the width of the first and second contact tabs narrowing on progression toward the free end portions.

12. The electrically conducting structure of claim 7, wherein the bar member is of a substantially circular rod shape, the free end portion of the contact portion comprises free end portions of the first and second contact portions that are in contact with an outer peripheral face of the bar member in response to the free end portions of the first and second contact portions being bent in the radial direction of the bar member.

13. The electrical apparatus of claim 5, wherein the bar member is of a substantially circular rod shape, the contact portion comprises a pair of contact tabs that extend out from the base portion in a cantilever manner in a direction along which leading ends of the contact tabs face each other, and the free end portion of the contact portion comprises free end portions of the contact tabs that are in contact with an outer peripheral face of the bar member in response to the free end portions of the first and second contact tabs being bent in the radial direction of the bar member.

14. The electrically conducting structure of claim 1, wherein the bar member is of a substantially circular rod shape, and both of the free end portions of the contact tabs bend in the radial direction in a same semicircle of a cross section of the bar member.

15. The electrically conducting structure of claim 1, wherein both of the free end portions of the contact tabs bend toward the base portion of the conducting metal plate.

* * * * *